US010288072B2

(12) United States Patent
Arnoldi

(10) Patent No.: US 10,288,072 B2
(45) Date of Patent: May 14, 2019

(54) SENSORLESS LOW FLOW ELECTRIC WATER PUMP AND METHOD OF REGULATING FLOW THEREWITH

(71) Applicant: Magna Powertrain, Inc., Concord (CA)

(72) Inventor: Ernesto Giovanni Arnoldi, Luserna S. Giovanni (IT)

(73) Assignee: MAGNA POWERTRAIN FPC LIMITED PARTNERSHIP, Aurora (CA)

( * ) Notice: Subject to any disclaimer, the term of this patent is extended or adjusted under 35 U.S.C. 154(b) by 392 days.

(21) Appl. No.: 14/721,401

(22) Filed: May 26, 2015

(65) Prior Publication Data

US 2015/0354576 A1 Dec. 10, 2015

Related U.S. Application Data

(60) Provisional application No. 62/009,572, filed on Jun. 9, 2014.

(51) Int. Cl.
*F04D 1/00* (2006.01)
*F04D 13/06* (2006.01)
(Continued)

(52) U.S. Cl.
CPC ..... *F04D 13/06* (2013.01); *F04D 1/00* (2013.01); *F04D 15/0066* (2013.01);
(Continued)

(58) Field of Classification Search
CPC ..... F04D 15/0066; F04D 1/00; F04D 15/0088–15/0094; F04D 15/0254; F04D 29/2283; F04D 13/06; F28F 13/06
(Continued)

(56) References Cited

U.S. PATENT DOCUMENTS 3,810,480 A * 5/1974 Smith ..... A47L 15/0031 134/104.1
4,893,067 A * 1/1990 Bhagwat ..... H02P 7/2885 318/599
(Continued)

FOREIGN PATENT DOCUMENTS

CN 2295065 Y 10/1998
CN 2418279 Y 2/2001
(Continued)

OTHER PUBLICATIONS

European Search Report dated Oct. 15, 2015 in corresponding European Patent Application No. EP15170333.
(Continued)

*Primary Examiner* — Alexander B Comley
(74) *Attorney, Agent, or Firm* — Dickinson Wright PLLC

(57) ABSTRACT

An electric fluid pump and method of regulating flow of liquid therethrough is provided. The pump has an electric motor including a stator and a rotor, wherein the rotor is supported for rotation to drive an impeller that is fixed thereto for rotation to pump coolant from a fluid inlet to a fluid outlet. A controller is in operable, closed loop communication with the electric motor, and the impeller is operable to rotate in a first rotary pumping direction and an opposite second rotary pumping direction in response to a signal from the controller. The first rotary pumping direction produces a first positive flow rate of coolant outwardly from the fluid outlet and the second rotary pumping direction produces a second positive flow rate of coolant outwardly from the fluid outlet, with the first positive flow rate being greater than the second positive flow rate.

23 Claims, 3 Drawing Sheets

(51) Int. Cl.

| | |
|---|---|
| ***F04D 15/00*** | (2006.01) |
| ***F04D 29/22*** | (2006.01) |
| ***F28F 13/06*** | (2006.01) |
| ***F04D 29/043*** | (2006.01) |

(52) U.S. Cl.
CPC ..... *F04D 29/2283* (2013.01); *F28F 13/06* (2013.01); *F04D 15/0094* (2013.01); *F04D 29/043* (2013.01); *F04D 29/22* (2013.01)

(58) Field of Classification Search
USPC ..... 417/22, 423.1, 423.7, 44.1, 42, 417/423.6–423.14; 123/41.02, 41.44, 123/41.46
See application file for complete search history.

(56) References Cited

U.S. PATENT DOCUMENTS

| | | | | |
|---|---|---|---|---|
| 5,586,862 | A | 12/1996 | Danner | |
| 6,497,201 | B1 * | 12/2002 | Werson | F04D 13/06 123/41.12 |
| 6,503,064 | B1 | 1/2003 | Croke et al. | |
| 2011/0048390 | A1 | 3/2011 | Washburn | |
| 2013/0259720 | A1 | 10/2013 | Mills et al. | |
| 2014/0017073 | A1 | 1/2014 | Muizelaar et al. | |
| 2014/0093393 | A1 | 4/2014 | Araki et al. | |

FOREIGN PATENT DOCUMENTS

| | | | |
|---|---|---|---|
| EP | 1406017 | A1 | 4/2004 |
| EP | 1554969 | A1 | 7/2005 |
| GB | 2353147 | A | 2/2001 |
| JP | 2004019511 | A | 1/2004 |
| WO | 2012004544 | A1 | 1/2012 |

OTHER PUBLICATIONS

Search Report dated May 24, 2018 in corresponding ChinesePatent Application No. 201510309078.6 (with English translation).

* cited by examiner

SENSORLESS LOW FLOW ELECTRIC WATER PUMP AND METHOD OF REGULATING FLOW THEREWITH

CROSS-REFERENCE TO RELATED APPLICATION

This application claims the benefit of U.S. Provisional Application Ser. No. 62/009,572, filed Jun. 9, 2014, which is incorporated herein by reference in its entirety.

FIELD

The present disclosure relates to an improved electric water pump and, more particularly, to a sensorless low flow electric water pump and method of controlling such an electric water pump.

BACKGROUND

This section provides background information related to the present disclosure which is not necessarily prior art.

Virtually all motor vehicles are equipped with a coolant pump, commonly referred to as a water pump, to circulate a liquid coolant through the engine cooling circuit for the purpose of controlling thermal transfer from the engine to the coolant for optimized engine operation. In many instances, the water pump is a belt-driven accessory drive arrangement driven off of the engine's crankshaft. Typically, some type of clutch is provided to regulate pump operation and minimize system losses. Recently, many vehicles have been equipped with electric water pumps that can be variable controlled to provide improved pumping efficiency. Many types of electric water pumps are used in vehicular operations, and are typically driven solely in a first or "pumping" direction. Limited rotation in a second direction is sometimes provided to dislodge debris.

A preferred method of controlling a brushless direct current (BLDC) motor is referred to as "sensorless control", where the position of the rotor relative to the stator is determined by reading the back electromotive force (EMF) generated by the magnets in the rotor passing the coils in the stator. This is preferred because it is less costly than use of sensors to detect the rotor position. The downside of sensorless control is that it limits the minimum speed that a motor can reach in closed loop control while maintaining an ability to read the EMF, which, for example, is typically about 10-15% of the maximum motor speed. A typical water pump operates at a maximum motor speed of about 6000 rpm, and thus, the minimum speed at which the sensorless control in a closed loop arrangement is generally effective is about 600 rpm. The water pump can run with sensorless control at lower speeds, but only in an open loop control arrangement. Unfortunately, without proper feedback to determine the position of the rotor relative to the stator, the pump may lose diagnostic capability (i.e. it cannot verify its operational accuracy) and, therefore, requires additional power to reliably ensure rotation.

Thus a need exists for an electric water pump that can provide a very low flow, while maintaining an ability to utilize sensorless control during the low flow condition, thereby avoiding the power penalty associated with running the pump in an open loop arrangement. The goal is to meet very low flow requirements relative to the maximum speed of the pump without need for expensive sensors, loss of diagnostic feedback and/or higher power consumption associated with conventional open loop control.

SUMMARY

This section provides a general summary of the present disclosure and is not intended to be a comprehensive disclosure of its full scope, aspect, objectives and/or features.

In accordance with one aspect of the invention, an electric fluid pump for use in motor vehicle is provided. The pump includes a pump housing defining a fluid chamber and a motor chamber. The fluid chamber is in fluid communication with a fluid inlet and a fluid outlet for providing flow of a coolant through said fluid chamber. The pump further includes an electric motor disposed within the motor chamber, with the electric motor including a stator and a rotor, wherein the rotor is supported for rotation relative to the stator by a rotor shaft extending along a longitudinal axis through the fluid chamber. Further yet, an impeller is fixed to the rotor shaft for rotation in the fluid chamber, with the impeller being operable to pump coolant from the fluid inlet to the fluid outlet. A controller is in operable communication with the electric motor, and the impeller is operable to rotate in a first rotary pumping direction and an opposite second rotary pumping direction in response to a signal from the controller. The first rotary pumping direction produces a first positive flow rate of coolant outwardly from the fluid outlet and the second rotary pumping direction produces a second positive flow rate of coolant outwardly from the fluid outlet, wherein the first positive flow rate is greater than the second positive flow rate.

It is an aspect of the present disclosure to provide an electric water pump for use in motor vehicle applications capable of providing very low coolant flow capabilities, such as while operating at a reduced percentage of its maximum operational speed, while maintaining closed loop control and low power requirements.

It is a related aspect of the present disclosure to provide an electric water pump providing very low coolant flow requirements relative to maximum coolant flow requirements without sensors, loss of diagnostic feedback, or higher power consumption of the type required for conventional electric pumps having low speed, open loop controls.

It is another aspect of the present disclosure to provide an electric water pump operable in a first rotary pumping direction to provide high coolant flow requirements and in a second rotary pumping direction to provide low coolant flow requirements in a fluid-based coolant system having a unidirectional coolant flow circuit. This aspect may be provided by an electrically-driven centrifugal water pump in the engine cooling system of a motor vehicle.

In accordance with yet another aspect of the invention, a method is provided for regulating the positive, unidirectional flow of fluid through an electric fluid pump having an electric motor, including a stator and a rotor supported for rotation relative to the stator by a rotor shaft, and having an impeller fixed to the rotor shaft for rotation to pump coolant from a fluid inlet to a fluid outlet, and having a controller in closed loop communication with the electric motor. The method includes commanding the impeller to rotate in a first rotary direction and an opposite second rotary direction in response to a signal received from the controller, with the first rotary direction producing a first positive flow rate of the coolant outwardly from the fluid outlet and the second rotary direction producing a second positive flow rate of the coolant outwardly from the fluid outlet, wherein the first positive flow rate is greater than the second positive flow rate.

In accordance with a further aspect of the invention, the method further includes continuously monitoring a real-time rotational speed of the impeller with the controller via closed loop control and comparing the real-time rotational speed with a predetermined target speed signal, and commanding the impeller to rotate in the relatively high flow rate first rotary direction when the target speed signal is greater than the real-time rotational speed, and commanding the impeller to rotate in the relatively low flow rate second rotary direction when the target speed signal is less than the real-time rotational speed.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

At least one example embodiment will now be detailed in conjunction with the accompanying drawings.

Figure 1:
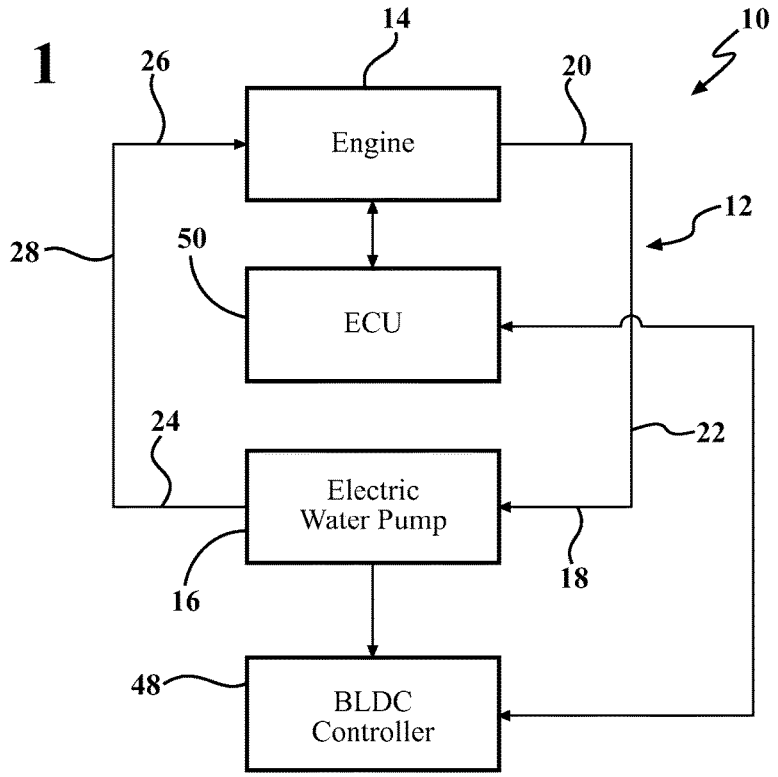
FIG. 1 is a schematic of a coolant system in accordance with one aspect of the invention for pumping liquid coolant through an engine of a motor vehicle.
Figure 2:
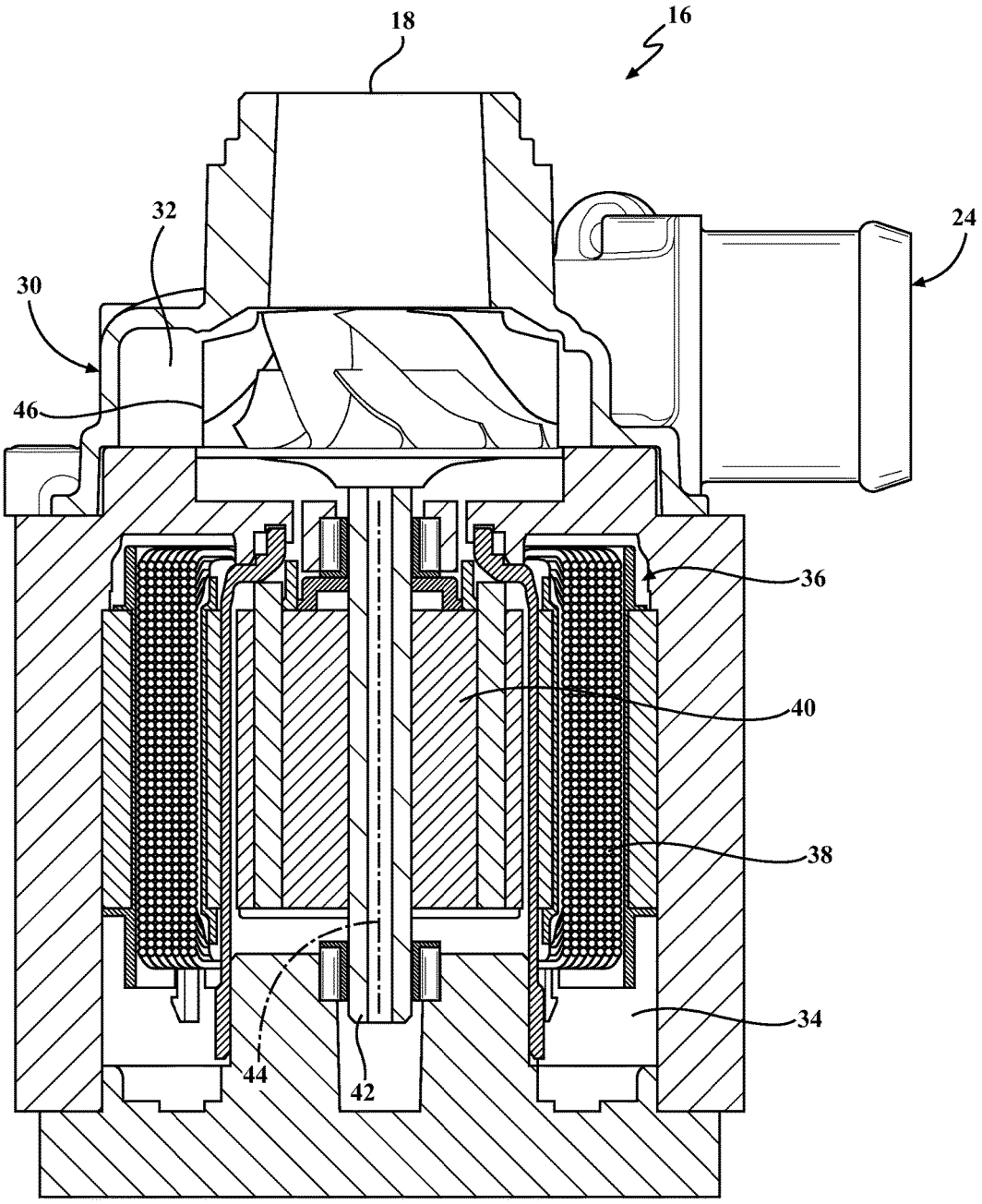
FIG. 2 is a cross-sectional view of an exemplary water pump of the coolant system of FIG. 1.

FIG. 1 shows a simplified schematic illustration of a motor vehicle 10 having a liquid coolant type cooling system 12 for optimally controlling heat transfer from an internal combustion engine 14. An electric fluid pump, also referred to as water pump or simply pump 16 (representative embodiment shown in FIG. 2), has an inlet 18 communicating with an outlet 20 of the engine's coolant flow circuit via a first flow pathway 22, while an outlet 24 of pump 16 communicates with an inlet 26 of the engine's coolant circuit via a second flow pathway 28. Obviously, engine 14 could also be other type of heat generating devices (i.e. electric traction motor, etc.) used to propel the vehicle 10. The water pump 16 is preferably a centrifugal type pump, such as shown in FIG. 2, or for example, as disclosed and described in U.S. Patent App. Publication Numbers 2013/0259720 and 2014/0017073, the entire disclosures of which are hereby incorporated by reference. The pump 16 has a housing 30 defining a fluid chamber 32 and a motor chamber 34, with the fluid chamber 32 being in fluid communication with the fluid inlet 18 and the fluid outlet 24 for providing unidirectional flow of a coolant through the fluid chamber 32. An electric motor 36 is disposed within the motor chamber 34. The motor 36 has a stator 38 and a rotor 40 supported for rotation within the stator 38 by a rotor shaft 42 extending along a longitudinal axis 44 through the fluid chamber 32. An impeller 46 is fixed to the rotor shaft 42 for rotation in the fluid chamber 32 to pump coolant from the fluid inlet 18 to the fluid outlet 24. A controller 48 is arranged in closed loop communication with the electric motor 36 to control the operation of the electric motor 36, including the operational speed and direction of rotation of the rotor 40. The impeller 46 is operable to rotate in a high flow first rotary direction, such as clockwise (CW), and an opposite low flow second rotary direction, such as counter-clockwise (CCW), in response to a signal from the controller 48. For a given rpm, rotation of the impellor 46 in the first rotary direction (+rpm) CW produces a first positive flow rate of coolant outwardly from the fluid outlet 24 and the second rotary direction (−rpm) CCW produces a second positive flow rate of coolant outwardly from the fluid outlet 24, wherein the first positive flow rate is substantially greater than the second positive flow rate for the given rpm (it should be recognized that the given rpm is the same for both directions CW, CCW with the exception of the direction of rotation CW, CCW). Accordingly, the pumping efficiency of the impeller 46 is greater in the positive direction (CW) than in the negative direction (CCW).

Figure 3:
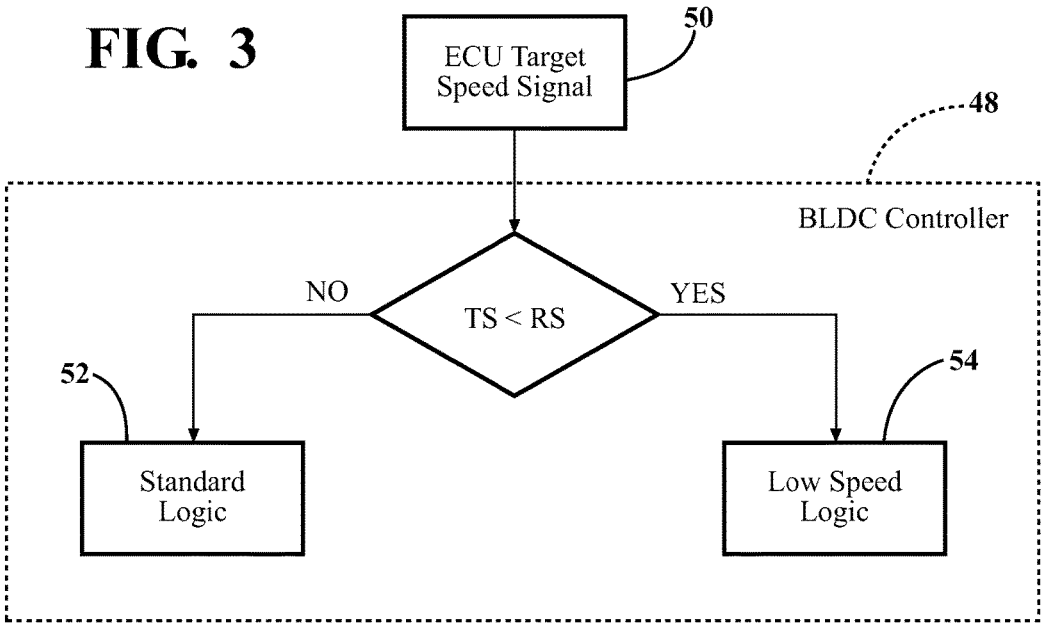
FIG. 3 is a schematic of a closed loop control system used to control the rotation direction of an impeller of the water pump.

As shown in FIG. 3, the controller 48 monitors a real-time rotational speed "RS" of the impeller 46, which correlates positively and directly with the flow rate of coolant, and compares the real-time impeller rotational speed RS with a desired target rotational speed in the form of a target speed signal "TS" from an engine control unit 50 (ECU). The controller 48 may include an electronic circuit board (ECB) electrically connected to the stator 38 and which can be mounted within the pump housing 30. The controller 48 is generally effective at monitoring the real-time rotational speed, via EMF feedback, to a rotational speed as low as about 600 rpm, which is generally a significantly reduced percentage of the maximum rotational speed of the motor 36. By way of example and without limitation, this reduced percentage can be in the range of 5-25% of the maximum rotational speed, and preferably in a range of 5-10%. The controller 48 automatically commands the motor 36, and thus impeller 46, via a standard logic signal 52 to the motor 36, to rotate in the high flow first rotary direction CW when the desired coolant flow rate, deduced via direct positive correlation by the target speed signal "TS", is greater than the real-time coolant flow rate, deduced via direct positive correlation by the real-time rotational speed RS, and conversely, the controller 48 automatically commands the motor 36, via a low speed logic signal 54, to reverse rotation of the impeller 46 to rotate in the second rotary direction CCW when the target speed signal "TS" is less than the real-time rotational speed RS. The transition time for the impeller 46 to change rotational directions can be nearly instantaneous and in one non-limiting example, be about 3 seconds or less. As such, the controller 48 is able to automatically and continuously produce the desired flow rate of coolant from the pump outlet 24 in closed loop arrangement by actively monitoring and regulating the speed and direction of rotation of the impeller 46, wherein the motor 36 generates low flux/low power consumption and impeller 46 generates a particularly low flow rate of coolant, including as low as about 3-5 L/min, for example, due at least in part to the pumping inefficiency of the impeller 46 while operating in the reverse CCW direction, while allowing full diagnostics at low pump speeds and low flow rate of coolant.

Accordingly, in accordance with one aspect of the invention, the pumping inefficiency of the impeller 46 in the reverse direction CCW is utilized intentionally to produce the desired low flow rate of coolant, such as in a startup condition or other condition requiring low coolant flow, while retaining the ability to monitor and regulate the pump 16 and coolant flow therefrom via relatively low cost, sensorless arrangement. The ability to use the sensorless arrangement is provided as a result of the pump 16 operating a rotational speeds of about 600 rpm or greater, whether in the positive rotational direction CW to produce a high coolant flow rate, such as greater than about 25 L/min, for example, or in the negative direction CCW to produce a low coolant flow rate, such as less than about 10 L/min. If desired, once in a commanded direction of rotation, whether CW or CCW, the control logic of the controller 48 can be programmed to maintain the impeller 46 in the commanded direction of rotation for a minimum about of time, such as about 20-30 seconds, by way of example and without limitation, thereby avoiding an overly rapid reversal of the impeller 46.

Figure 4:
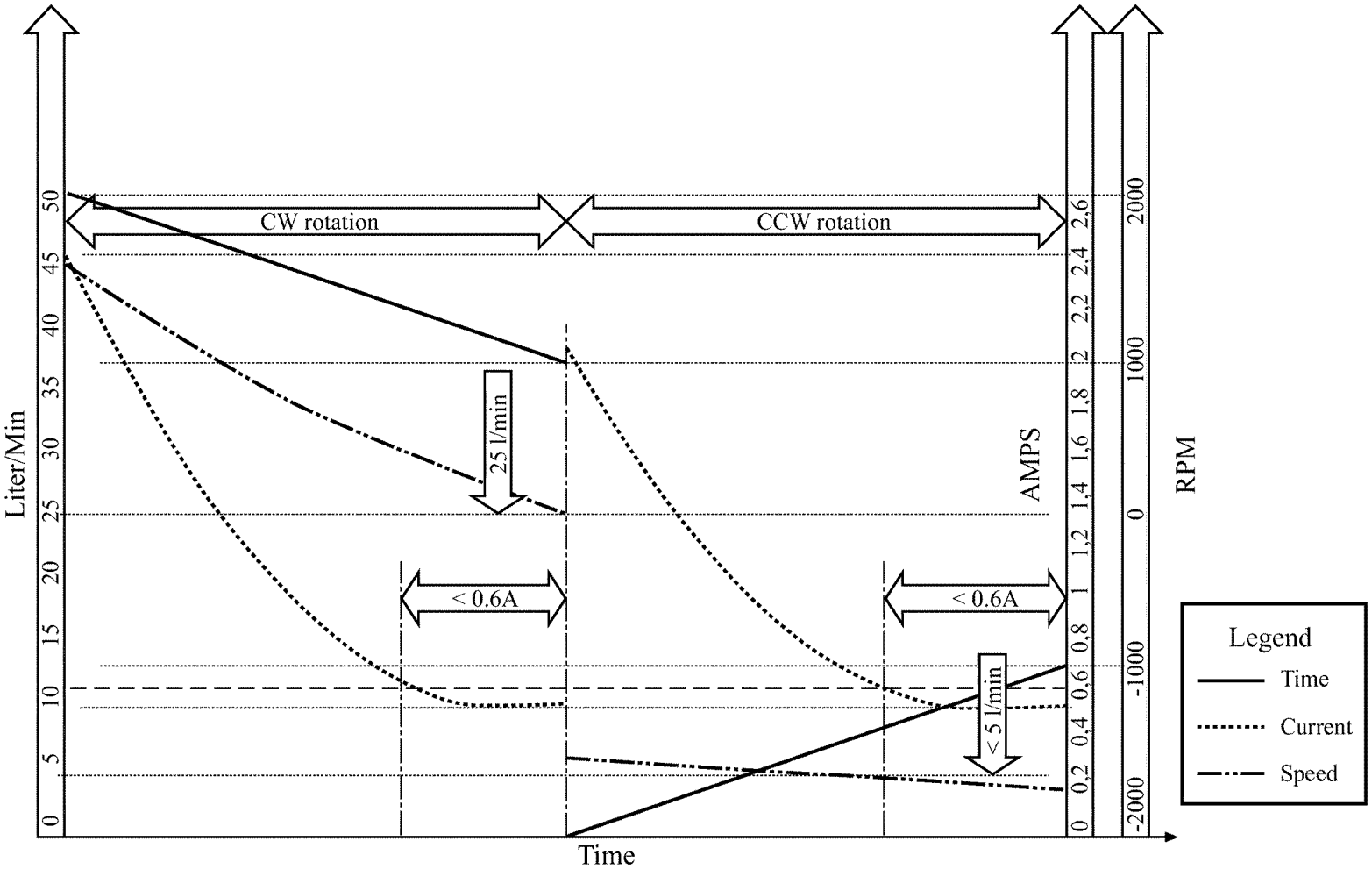
FIG. 4 is a graph illustrating various characteristics of a pump constructed in accordance with an exemplary embodiment of the invention while operating in opposite rotational directions.

In FIG. 4, empirical data is illustrated for a pump 16 constructed in accordance with one embodiment of the invention, by way of example and without limitation, though it should be recognized that pumps constructed in accordance with the invention can vary from one another while remaining within the scope of the invention. Of particularly noteworthy mention is the ability to produce a low coolant flow rate, such as between about 3-5 L/min at a current draw less than about 0.6 amps, by way of example and without limitation, in a closed loop diagnostic arrangement. This is particularly useful in a start-up condition, when there is a low coolant demand in the engine, and during idle or other low coolant demand scenarios. During the low coolant flow conditions, the heat generated by the motor 36 and surrounding electronics can flow to the coolant, thereby acting to maintain the motor 36 and electronics, such as the controller 48, for example, at optimal operating temperatures.

In accordance with another aspect of the invention, a method of regulating the positive, unidirectional flow of fluid through an outlet 24 of an electric fluid pump 16 having electric motor 36, including a stator 38 and a rotor 40 supported for rotation within the stator 38 by a rotor shaft 42, and having an impeller 46 fixed to the rotor shaft 42 for rotation to pump coolant from a fluid inlet 18 to the fluid outlet 24, and having a controller 48 in closed loop communication with the electric motor 36 is provided. The method includes commanding the impeller 46 to rotate in a first rotary direction CW and an opposite second rotary direction CCW in response to a signal received from the controller 48, with the first rotary direction CW producing a first positive flow rate of the coolant outwardly from the fluid outlet 24 and the second rotary direction producing a second positive flow rate of the coolant outwardly from the fluid outlet 24, wherein the first positive flow rate is greater than the second positive flow rate.

The method further includes continuously or substantially continuously monitoring a real-time rotational speed RS of the impeller 46 with the controller via closed loop control and comparing the real-time rotational speed RS with a predetermined target speed signal TS, and commanding the impeller 46 to rotate in the first rotary direction CW when the target speed signal TS is greater than the real-time rotational speed RS, and commanding the impeller 46 to rotate in the second rotary direction CCW when the target speed signal TS is less than the real-time rotational speed RS.

The method further includes rotating the impeller 46 at a minimum operational positive rotational speed, by way of example and without limitation, of about 600 rpm in the first rotary direction CW and at a minimum operational negative rotational speed of about −600 rpm in the second rotary direction CCW, taking into account, of course, the transition rotational speeds therebetween.

The method further includes causing the first positive flow rate to increase as the positive rotational speed of the impeller 46 increases, and causing the second positive flow rate to increase as the negative rotational speed of the impeller increases.

The method further includes configuring the impeller 46 to have a first pumping efficiency while rotating in the high flow rate first rotary direction CW and a second pumping efficiency that is less than the first pumping efficiency while rotating in the low flow rate second rotary direction CCW.

The method can further include configuring the electric motor 36 to draw less than about 0.6 amps while the impeller 46 rotates in the low flow rate second rotary direction CCW to produce a second positive flow rate that is less than about 10 liters per minute, and preferably between about 3-5 liters per minute.

The present disclosure relates to an electric water pump 16 having a rotary pump member 46 capable of being driven by an electric motor 36 in a sensorless closed loop control system in a first rotary direction CW and a second rotary direction CCW. The first rotary direction CW is used to regulate pumping characteristics, such as flow rate, when the target pump speed TS is above a determined value RS. The second rotary direction CCW is used to regulate the pumping characteristic when the target pump speed TS is less than the determined value RS. Control in both directions CW, CCW is with similar low power requirements with the structure of the pump member 46 providing less efficient pumping action when driven in the second direction CW.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed:

1. An electric fluid pump for use in a motor vehicle, the electric fluid pump comprising:

a pump housing defining a fluid chamber and a motor chamber, said fluid chamber being in fluid communication with a fluid inlet and a fluid outlet for providing a unidirectional flow of a coolant through said fluid chamber;

an electric motor disposed within said motor chamber, said electric motor including a stator and a rotor, said rotor being supported for rotation relative to said stator by a rotor shaft extending along a longitudinal axis through said motor chamber;

an impeller fixed to said rotor shaft for rotation in said fluid chamber and operable to pump coolant from said fluid inlet to said fluid outlet; and a controller in closed loop communication with said electric motor;

wherein said impeller is operable to rotate in a first rotary direction and an opposite second rotary direction in response to a signal from said controller, said first rotary direction producing a first positive flow rate of coolant outwardly from said fluid outlet and said second rotary direction producing a second positive flow rate of coolant outwardly from said fluid outlet, and wherein said first positive flow rate is greater than said second positive flow rate;

wherein said controller monitors a real-time rotational speed of said impeller and compares said real-time rotational speed with a predetermined target speed, wherein said controller commands said impeller to rotate in said first rotary direction when said target speed signal is greater than said real-time rotational speed to produce the first positive flow rate of the coolant, and wherein said controller commands said impeller to rotate in said second rotary direction when said target speed signal is less than said real-time rotational speed to produce the second flow rate of coolant;

wherein said controller is configured to command said impeller to rotate in said first rotary direction at a maximum first direction rotational speed, wherein said controller is configured to command said impeller to rotate in said second rotary direction at a minimum second direction rotational speed, wherein said minimum second direction rotational speed is at least 5% of said maximum first direction rotational speed.

2. The electric fluid pump of claim 1 wherein said electric motor is a brushless direct current motor.

3. The electric fluid pump of claim 1 wherein said impeller further rotates at a minimum first direction rotational speed in said first rotary direction.

4. The electric fluid pump of claim 3 wherein said first positive flow rate increases as the first direction rotational speed of said impeller increases, and said second positive flow rate increases as the second direction rotational speed of said impeller increases.

5. The electric fluid pump of claim 1 wherein said impeller has a first pumping efficiency while rotating in said first rotary direction and a second pumping efficiency while rotating in said second rotary direction, said first pumping efficiency being greater than said second pumping efficiency.

6. The electric fluid pump of claim 1 wherein said electric motor draws less current while said impeller rotates in said second rotary direction.

7. The electric fluid pump of claim 1 wherein the fluid inlet is positioned generally perpendicularly to the fluid outlet, and wherein the rotor and stator are each axially spaced from the fluid inlet and the fluid outlet.

8. The electric fluid pump of claim 1 wherein the minimum second direction rotational speed is between 5% and 10% of the maximum first direction rotational speed.

9. The electric fluid pump of claim 1, wherein said fluid inlet is a single fluid inlet of said fluid chamber and said fluid outlet is a single fluid outlet of said fluid chamber, wherein all of the coolant entering said fluid chamber through said single fluid inlet will exit said fluid chamber through said single fluid outlet.

10. The electric fluid pump of claim 1 wherein said fluid chamber defines a chamber base surface disposed perpendicular to the longitudinal axis, and said impeller defines an impeller base surface disposed perpendicular to the longitudinal axis, wherein the chamber base surface and the impeller base surface are co-planar.

11. A method of regulating a positive, unidirectional flow of fluid through a fluid chamber to a fluid outlet of an electric fluid pump having an electric motor, including a stator having coils and a rotor having magnets supported for rotation within the stator by a rotor shaft, and having an impeller fixed to the rotor shaft for rotation to pump coolant from a fluid inlet to the fluid outlet, and having a controller in closed loop communication with the electric motor, comprising:

commanding the impeller to rotate in a first rotary direction and an opposite second rotary direction in response to respective signals received from the controller, with the first rotary direction producing a first positive flow rate of the coolant outwardly from the fluid outlet and the second rotary direction producing a second positive flow rate of the coolant outwardly from the fluid outlet, wherein the first positive flow rate is greater than the second positive flow rate;

continuously monitoring a real-time rotational speed of the impeller with the controller by reading a back electromotive force generated by the magnets in the rotor passing the coils in the stator and via closed loop control and comparing the real-time rotational speed with a predetermined target speed signal, and commanding the impeller to rotate in the first rotary direction when the target speed signal is greater than the real-time rotational speed to produce the first positive flow rate of the coolant, and commanding the impeller to rotate in the second rotary direction when the target speed signal is less than the real-time rotational speed to produce the second positive flow rate of the coolant.

12. The method of claim 11 further including providing the electric motor as a brushless direct current motor.

13. The method of claim 11 further including rotating the impeller at a minimum first direction rotational speed in the first rotary direction and at a minimum second direction rotational speed in the second rotary direction.

14. The method of claim 13 further including causing the first positive flow rate to increase as the first direction rotational speed of the impeller increases, and causing the second positive flow rate to increase as the second direction rotational speed of the impeller increases.

15. The method of claim 11 further including configuring the impeller to have a first pumping efficiency while rotating in the first rotary direction and a second pumping efficiency that is less than the first pumping efficiency while rotating in the second rotary direction.

16. The method of claim 11 further including configuring the electric motor to draw less than about 0.6 amps while the impeller rotates in the second rotary direction.

17. The method of claim 11 wherein the controller commands the impeller to rotate in the second rotary direction during a start-up condition of an automobile engine when there is a low coolant demand in the automobile engine.

18. The method of claim 11 wherein the controller commands the impeller to rotate in the secondary rotary direction at a rotational speed of 600 RPM or greater.

19. An electric fluid pump for use in a liquid coolant system of a motor vehicle, the electric fluid pump comprising:

a pump housing defining a fluid chamber and a motor chamber, said fluid chamber being in fluid communication with a fluid inlet and a fluid outlet for providing a unidirectional flow of a liquid coolant through said fluid chamber;

an electric motor disposed within said motor chamber, said electric motor including a stator having coils and a rotor having magnets which is supported for rotation relative to said stator by a rotor shaft;

an impeller fixed to said rotor shaft for rotation in said fluid chamber and operable to pump the liquid coolant from said fluid inlet to said fluid outlet; and a controller in closed loop communication with said electric motor, said impeller is operable to rotate in a first rotary direction and an opposite second rotary direction in response to a signal from said controller, said first rotary direction producing a first positive flow rate of coolant outwardly from said fluid outlet and said second rotary direction producing a second positive flow rate of coolant outwardly from said fluid outlet, and wherein said first positive flow rate is greater than said second positive flow rate;

wherein said controller monitors a real-time rotational speed of said impeller by reading a back electromotive force generated by the magnets in the rotor passing the coils in the stator and compares said real-time rotational speed with a predetermined target speed signal, wherein said controller commands said impeller to rotate in said first rotary direction when said target speed signal is greater than said real-time rotational speed to produce the first positive flow rate of the coolant, and wherein said controller commands said impeller to rotate in said second rotary direction when said target speed signal is less than said real-time rotational speed to produce the second positive flow rate of coolant.

20. The electric fluid pump of claim 19 wherein said electric motor is a brushless direct current motor.

21. The electric fluid pump of claim 19 wherein said impeller rotates at a minimum positive operational rotational speed in said first rotary direction and at a minimum negative operational rotational speed in said second rotary direction.

22. The electric fluid pump of claim 21 wherein said first positive flow rate increases as the positive rotational speed of said impeller increases, and said second positive flow rate increases as the negative rotational speed of said impeller increases.

23. The electric fluid pump of claim 19 wherein said impeller has a first pumping efficiency while rotating in said first rotary direction and a second pumping efficiency while rotating in said second rotary direction, said first pumping efficiency being greater than said second pumping efficiency.

* * * * *